US006585132B2

(12) United States Patent
Kim

(10) Patent No.: US 6,585,132 B2
(45) Date of Patent: Jul. 1, 2003

(54) TABLET CASSETTE ASSEMBLY WITH SLIDER CABINETS FOR AUTOMATIC TABLET DISPENSING AND PACKAGING SYSTEM

(76) Inventor: Jun H. Kim, 100-23, Galsandong, Dalsuhgu, Taegu (KR)

( * ) Notice: Subject to any disclaimer, the term of this patent is extended or adjusted under 35 U.S.C. 154(b) by 99 days.

(21) Appl. No.: 09/962,020

(22) Filed: Sep. 24, 2001

(65) Prior Publication Data

US 2003/0057225 A1 Mar. 27, 2003

(51) Int. Cl.[7] ..... G07F 11/10; G07F 11/48
(52) U.S. Cl. ..... 221/133; 221/124; 53/154
(58) Field of Search ..... 221/119, 121, 221/123, 124, 133, 129; 53/154, 237

(56) References Cited

U.S. PATENT DOCUMENTS 4,664,289 A * 5/1987 Shimizu et al. ..... 221/2
5,348,061 A * 9/1994 Riley et al. ..... 141/104
5,709,063 A * 1/1998 Yuyama et al. ..... 53/154
5,852,911 A * 12/1998 Yuyama et al. ..... 53/168
5,901,876 A * 5/1999 Yuyama et al. ..... 221/133
6,012,602 A * 1/2000 Yuyama et al. ..... 221/130
6,050,064 A * 4/2000 Yuyama et al. ..... 53/514
6,145,700 A * 11/2000 Takahashi et al. ..... 221/133
6,471,090 B1 * 10/2002 Inamura et al. ..... 221/124
6,478,185 B2 * 11/2002 Kodama et al. ..... 221/6
6,481,180 B1 * 11/2002 Takahashi et al. ..... 53/237

* cited by examiner

*Primary Examiner*—Donald P Walsh
*Assistant Examiner*—Daniel K Schiak
(74) *Attorney, Agent, or Firm*—Park & Sutton LLP; John K. Park

(57) ABSTRACT

A tablet supplying and packaging system comprises a tablet packaging unit having an upper portion, a base cabinet on top of the upper portion. The base cabinet defined by front, rear surfaces and side ends. One of the side ends is swingably engaged to the tablet packaging unit. One or more slider cabinets each defined by longer side surfaces and shorter side surfaces are horizontally aligned in rear of the base cabinet such that each longer side surface becomes perpendicular to the rear surface of the base cabinet. The slider cabinets are linearly slidable to move back and forth so the slider cabinet sliding can be effected when the base cabinet is swung open, whereby the slider cabinets are selectively pulled out through a space reserved by opening the base cabinet.

31 Claims, 8 Drawing Sheets

TABLET CASSETTE ASSEMBLY WITH SLIDER CABINETS FOR AUTOMATIC TABLET DISPENSING AND PACKAGING SYSTEM

BACKGROUND OF THE INVENTION

The invention relates to a pharmaceutical automation system. More particularly, the present invention relates to a tablet cassette cabinet assembly for an automatic tablet dispensing and packaging system, which substantially increases tablet cassette capacity within a limited space reserved for the system while improving tablet cassette management efficiency.

An automatic tablet dispensing and packaging system is generally provided with a tablet packaging portion and a tablet dropping portion placed above the packaging portion. The tablet dropping portion includes a plurality of tablet cassettes containing different sets of tablets.

In order to increase capacity for housing the tablet cassettes, a flat type cabinet or a cylindrical type cabinet has been widely adopted to stack therein as many tablet cassettes as the system allows. Each tablet in the tablet cassettes comes to fall through a hole into the tablet packaging portion. So each hole inevitably holds on its wall either dusts or debris out of the dropping tablets. A tiny amount of tablet debris may result in medical care for a patient taking tablets packaged through the conventional tablet dispensing and packaging system.

A strong demand in the market is to provide a system that the hole for tablet passage can be easily cleaned or vacuumed while increasing system capacity of housing tablet cassettes.

SUMMARY OF THE INVENTION

Accordingly, it is an object of the present invention to provide an automatic tablet dispensing and packaging system with slider cabinets, that facilitates cleaning and vacuuming of tablet passages through which tablets are dropped in a tablet packaging unit.

Another object of the present invention is to substantially increase capacity of housing tablet cassettes in the system while facilitating management efficiency of the system.

To achieve the above-described objects, the tablet supplying and packaging system according to the present invention comprises a tablet packaging unit having an upper portion and a first base cabinet mounted on top of the upper portion of the tablet packaging unit. The base cabinet is defined by a front surface, a rear surface and side ends, wherein one of the side ends is swingably engaged to the tablet packaging unit.

The system also includes one or more slider cabinets each defined by longer side surfaces and shorter side surfaces. The slider cabinets are horizontally aligned in rear of the base cabinet such that said each longer side surface of the slider cabinets becomes perpendicular to the rear surface of the base cabinet. The slider cabinets are linearly slidable to move back and forth so that the forward sliding of the slider cabinets can be effected when the base cabinet is swung open, whereby the slider cabinets are selectively pulled out through a space reserved by opening the base cabinet.

In a preferred version, the system includes a plurality of tablet cassettes each containing therein and dropping therefrom a predetermined number of tablets. The tablet cassettes are detachably racked in said each cabinet in columns and rows. The system further includes a guide hopper disposed beneath the cabinets into the tablet packaging unit so as to guide the tablets selectively dropped from the tablet cassettes into the tablet packaging unit, and a controller to administer the tablet dropping from the tablet cassettes and the tablet packaging in the tablet packaging unit.

For a better version, the system may include first and second base cabinets each defined by a front surface, a rear surface, an inner side end and an outer side end, wherein said each base cabinet is mounted on top of the upper portion of the tablet packaging unit and linearly aligned such that the inner side ends of the base cabinets approach each other, wherein one of the side ends of said each base cabinet is swingably engaged to the tablet packaging unit.

Alternately, the system according to the present invention includes at least first to fourth base cabinets each defined by a front surface, a rear surface, and inner side end and an outer side end. The first and second base cabinets are mounted on top of the upper portion of the tablet packaging unit and linearly aligned such that the inner side ends of the first and second base cabinets approach each other. One of the side ends of said each first and second base cabinet is swingably engaged to the tablet packaging unit, wherein one of the side ends of said each third and fourth base cabinet is swingably engaged to said each first and second base cabinet;

The advantages of the automatic tablet dispensing and packaging system according to the present invention are numerous in that: the swingable mechanism of the tablet cassette cabinets enables a simultaneous vacuuming of each tablet passage in each cabinet by simply opening the base cabinets, wherein each tablet is dropped from each tablet cassette through the upright tablet passage into the tablet packaging unit; and the sliding mechanism of the tablet cassettes in combination with the swing mechanism substantially increases tablet cassette capacity as well as improving tablet cassette management efficiency in a limited system installation space.

Although the present invention is briefly summarized, the fuller understanding of the invention can be obtained by the following drawings, detailed description and appended claims.

BRIEF DESCIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
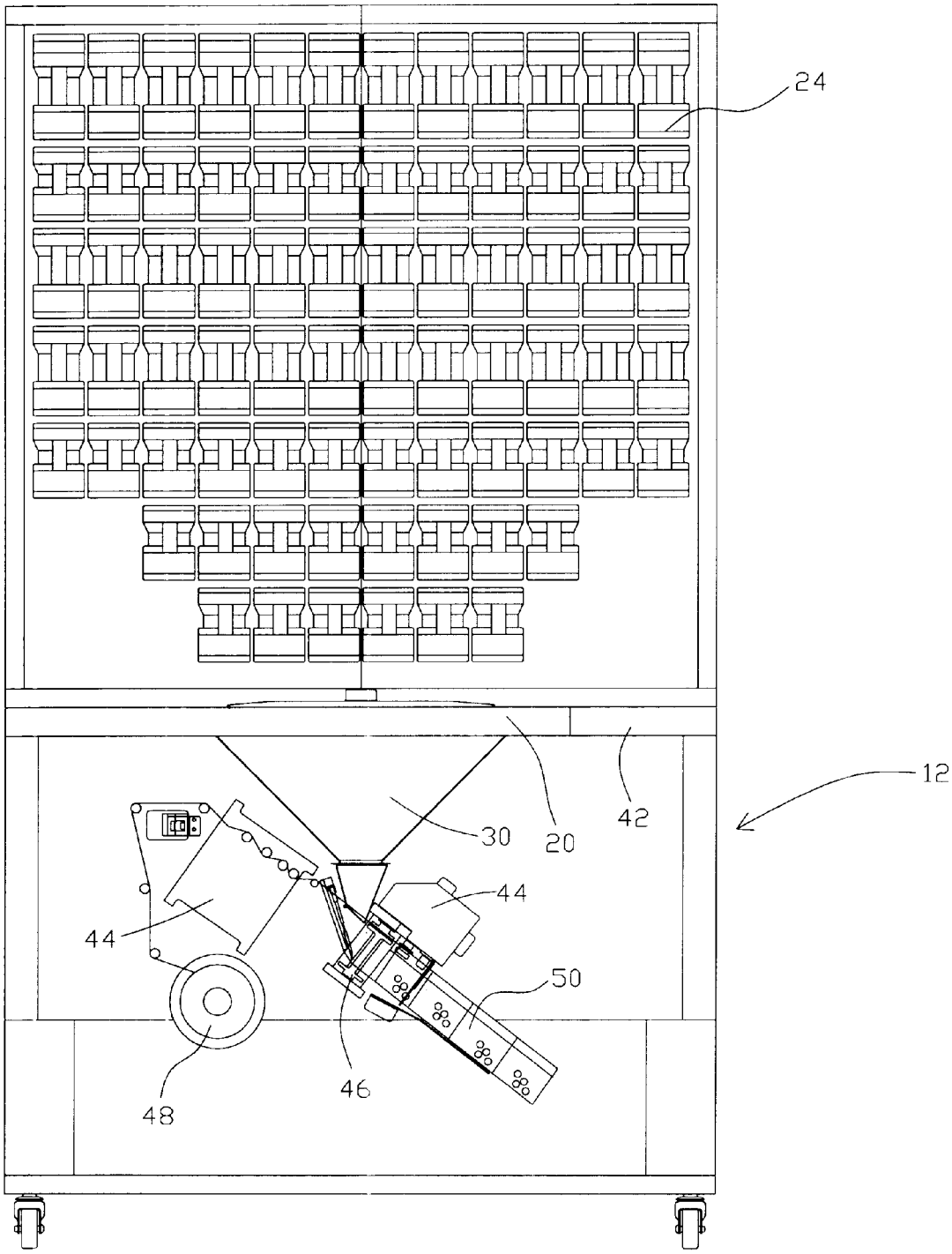
FIG. 1 is a schematic front view of an automatic tablet dispensing and packaging system according to the present invention.
Figure 2:
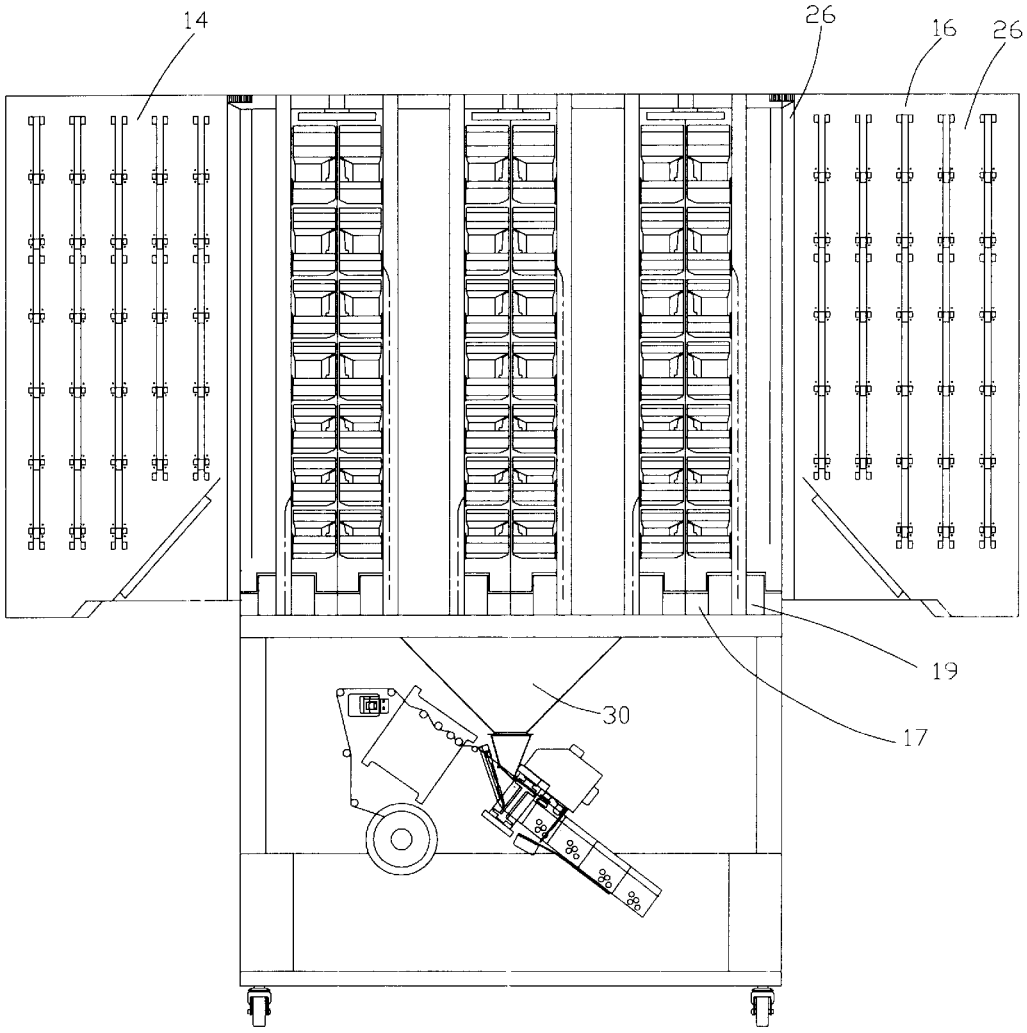
FIG. 2 is a base cabinet-opened front view of the automatic tablet dispensing and packaging system according to the present invention.

As shown in FIGS. 1 and 2, an automatic tablet dispensing and packaging system 10 according to a preferred embodiment of the present invention includes a tablet packaging unit 12, first and second base cabinets 14, 16 and one or more slider cabinets 18. The tablet packaging unit 12 includes an upper portion 20. The base cabinets 14, 16 are mounted on top of the upper portion 20 of the tablet packaging unit 12. The tablet packaging unit 12 includes a printer 44 to print respective information on a packaging paper 48, a heater assembly 46 to package the tablets 28 released through the guide hopper 30 into one or more partitioned paper bags 50 using the packaging paper 48.

Each cabinet 14, 16, 18 is formed to supportedly contain a plurality of tablet cassettes 24 and tablet passages 26 communicating with the tablet cassettes 24 which are upright-aligned in columns and rows. As further shown in FIG. 3, a predetermined kind of tablets 28 are stored in each tablet cassette 24 in form of capsules or pills and a designated amount of tablets 28 are controllably released one by one into the tablet passages 26. The tablets 28 released from each tablet cassette 24 are guided by each tablet passage 26 into a guide hopper 30 and then into the tablet packaging unit 12.

Figure 8:
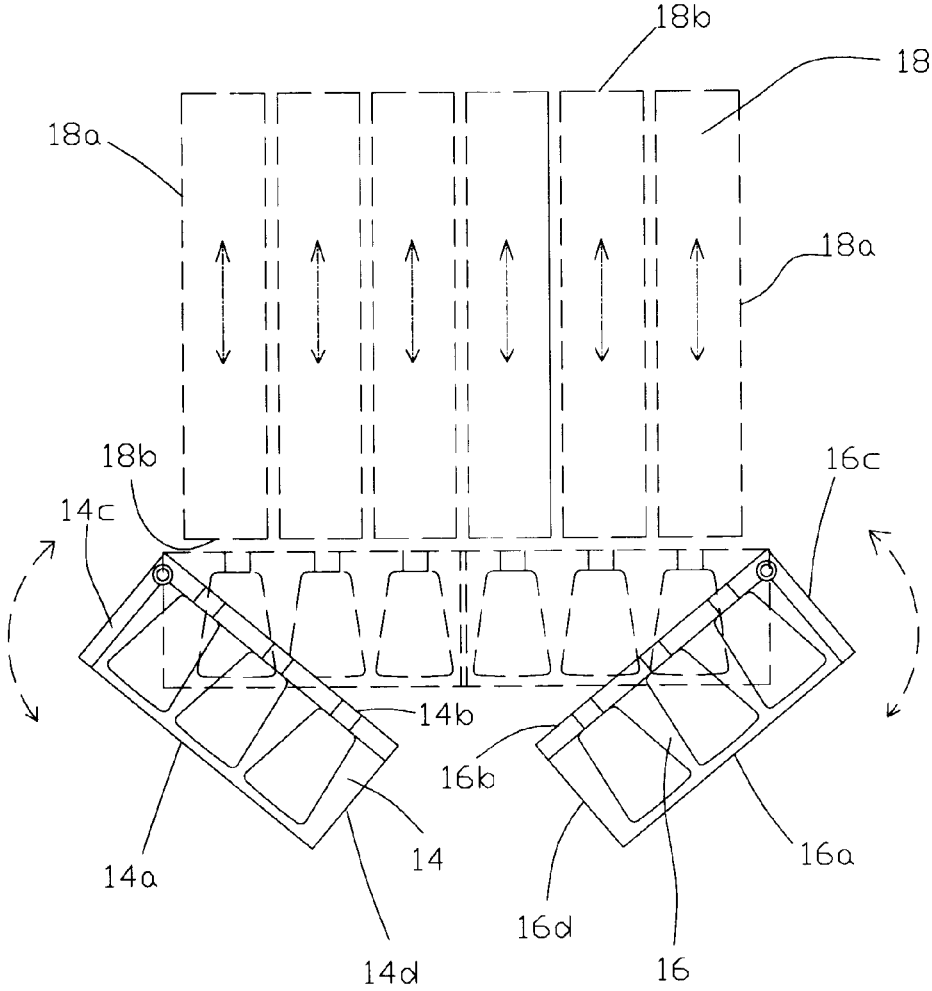

Referring to FIG. 2 in view of FIG. 8, the base cabinets 14, 16 are each defined by a front surface 14*a*, 16*a*, a rear surface 14*b*, 16*b*, an outer side end 14*c*, 16*c*, and an inner side end 14*d*, 16*d*, wherein one of the side ends 14*c*, 16*c* is swingably engaged to the tablet packaging unit 12. The first and second base cabinets 14, 16 are linearly aligned such that the inner side ends 14*d*, 16*d* of the base cabinets 14, 16 approach each other. In this construction, the side ends 14*c*, 16*c* of the base cabinets 14, 16 become swingably engaged to the tablet packaging unit 12.

For the swingable engagement between the base cabinets 14, 16 and the upper portion 20 of tablet packaging unit 12 there may be employed connection devices such as hinges, swivels, hooks, and other known connection derivatives.

The slider cabinets 18 are each defined by longer side surfaces 18*a* and shorter side surfaces 18*b*. The slider cabinets 18 are each horizontally aligned in rear of the base cabinets 14, 16 such that each longer side surface 18*a* of the slider cabinets 18 becomes perpendicular to the rear surface 14*b*, 16*b* of the base cabinets 14, 16. Preferably, the slider cabinets 18 are linearly slidable to move back and forth through the space reserved by opening of the base cabinets 14, 16 so that the forward (toward the base cabinets) sliding of the slider cabinets can be implemented when the base cabinets 14, 16 are swung open. Subsequently, the slider cabinets 18 are selectively pulled out through the space reserved by opening the base cabinets 14, 16. The slider cabinets 18 may be partitioned in one or more pairs to enable a pair-by-pair sliding.

The plurality of tablet cassettes 24 each containing therein and dropping therefrom a predetermined number of tablets are detachably racked in each cabinet 14, 16, 18 in columns and rows. In a preferred version, the tablet dispensing and packaging system 10 further includes a guide hopper 30 and a controller 42. The guide hopper 30 is disposed beneath the cabinets 14, 16, 18 into the tablet packaging unit 12 so as to guide the tablets 28 selectively dropped from the tablet cassettes into the tablet packaging unit 12. The controller 42 is provided adjacent to the table packaging unit 12 to administer the tablet dropping from the tablet cassettes 24 and the tablet packaging in the tablet packaging unit 12.

In this cabinet construction, the base cabinets 14, 16 become swingable onto and from the shorter side surfaces 18*b* of the slider cabinets 18 facing toward the base cabinets 14, 16 so that the first and second base cabinets 14, 16 can be attached to and swiveled on the upper portion 20 of the tablet packaging unit 12 to open when required for filling tablet cassettes with tablets or cleaning the tablet passages 26. The slider cabinets 18 may be supported by a framework 19 as high as the tablet packaging unit 12.

Figure 3:
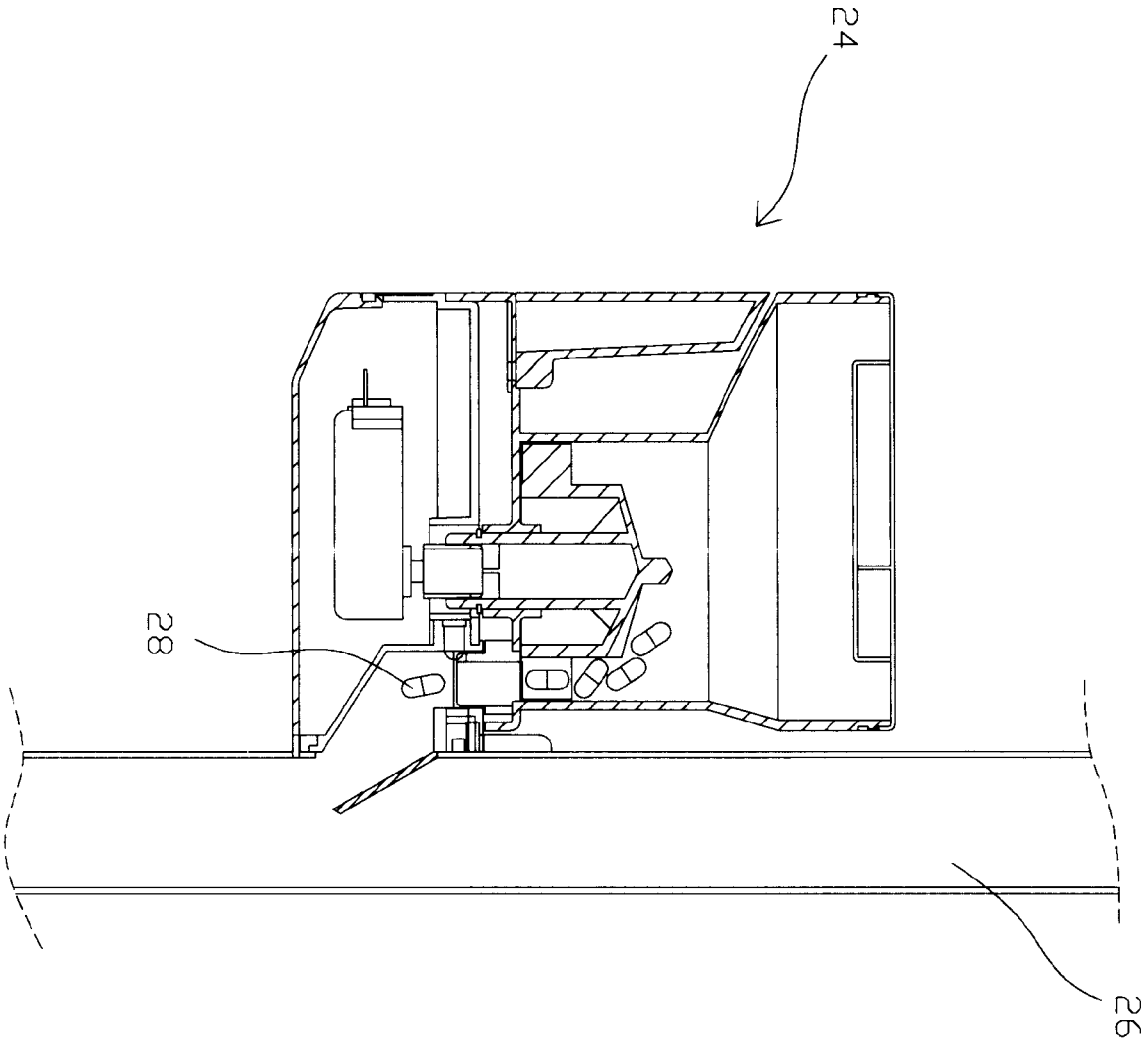
FIG. 3 is a structural view showing a tablet cassette and an annexed tablet passage for the system of the present invention.

Further referring to FIG. 3, the tablet passages 26 are formed in an upright alignment and attached to each cabinet while communicating with the corresponding tablet cassettes in each cabinet. The upright tablet passages 26 are aligned with the tablet cassette columns to facilitate the tablet guidance from the tablet cassettes 24 into the tablet packaging unit 12.

Figure 4:
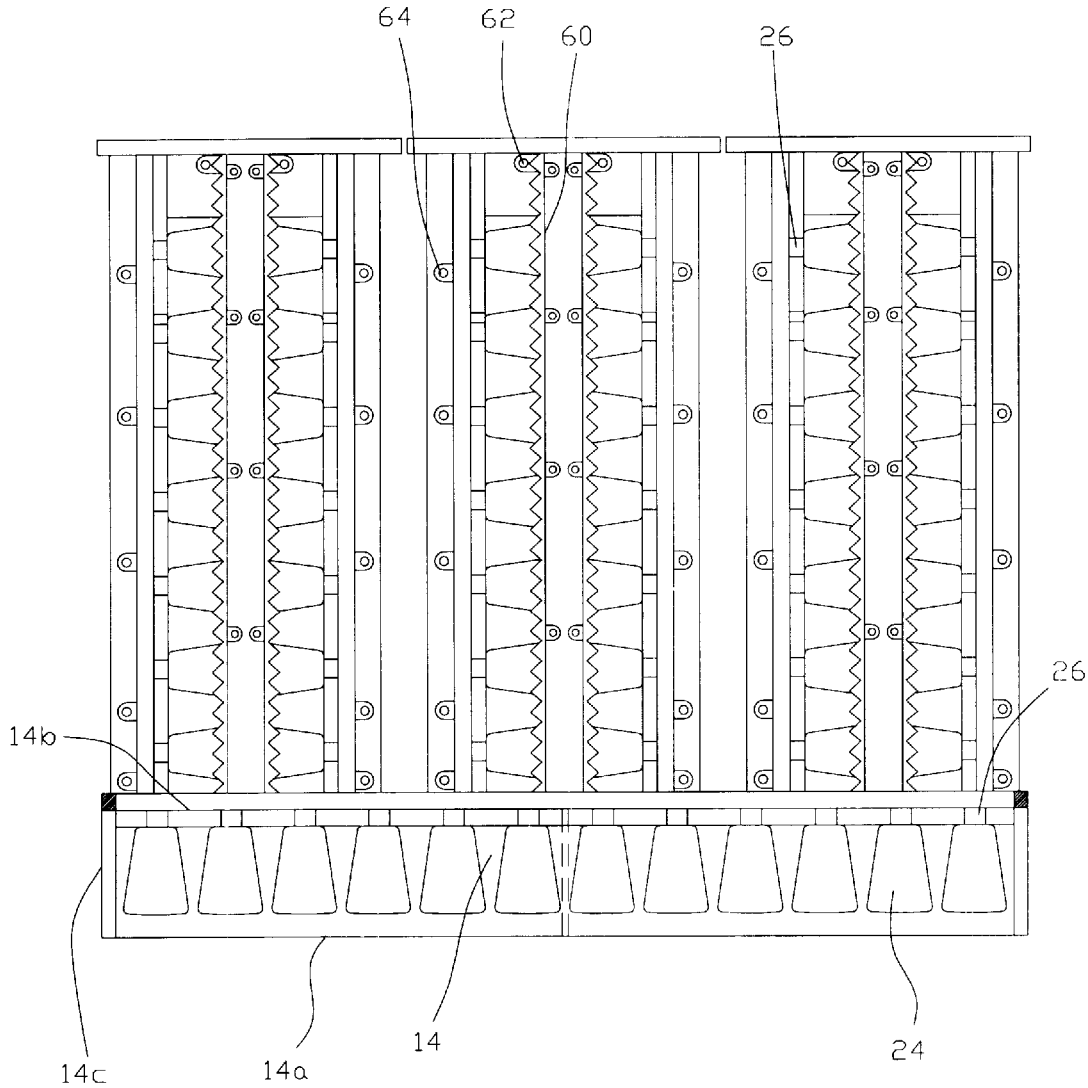
FIG. 4 is a schematic top view of the system in FIG. 1, reflecting slider cabinets in rear of the base cabinet according to an embodiment of the present invention.

FIG. 4 shows a plan view of FIG. 1 reflecting FIG. 2. As shown therein, when the base cabinets 14, 16 are swung open, the upright tablet passages 26 of the base cabinets 14, 16 are externally exposed so as to facilitate either cleaning or vacuuming of their tablet passages 26. Here, the cleaning or vacuuming of tablet passages 26 should be implemented not only for the tablet passages themselves but also for safety of patients who takes dosages prepared via the tablet dispensing and packaging system 10. Here, the upright tablet passages 26 for the base cabinets 14 are aligned in columns along the corresponding shorter side surfaces 18*b* of the slider cabinets 18 when closed for system operation.

Figure 5:
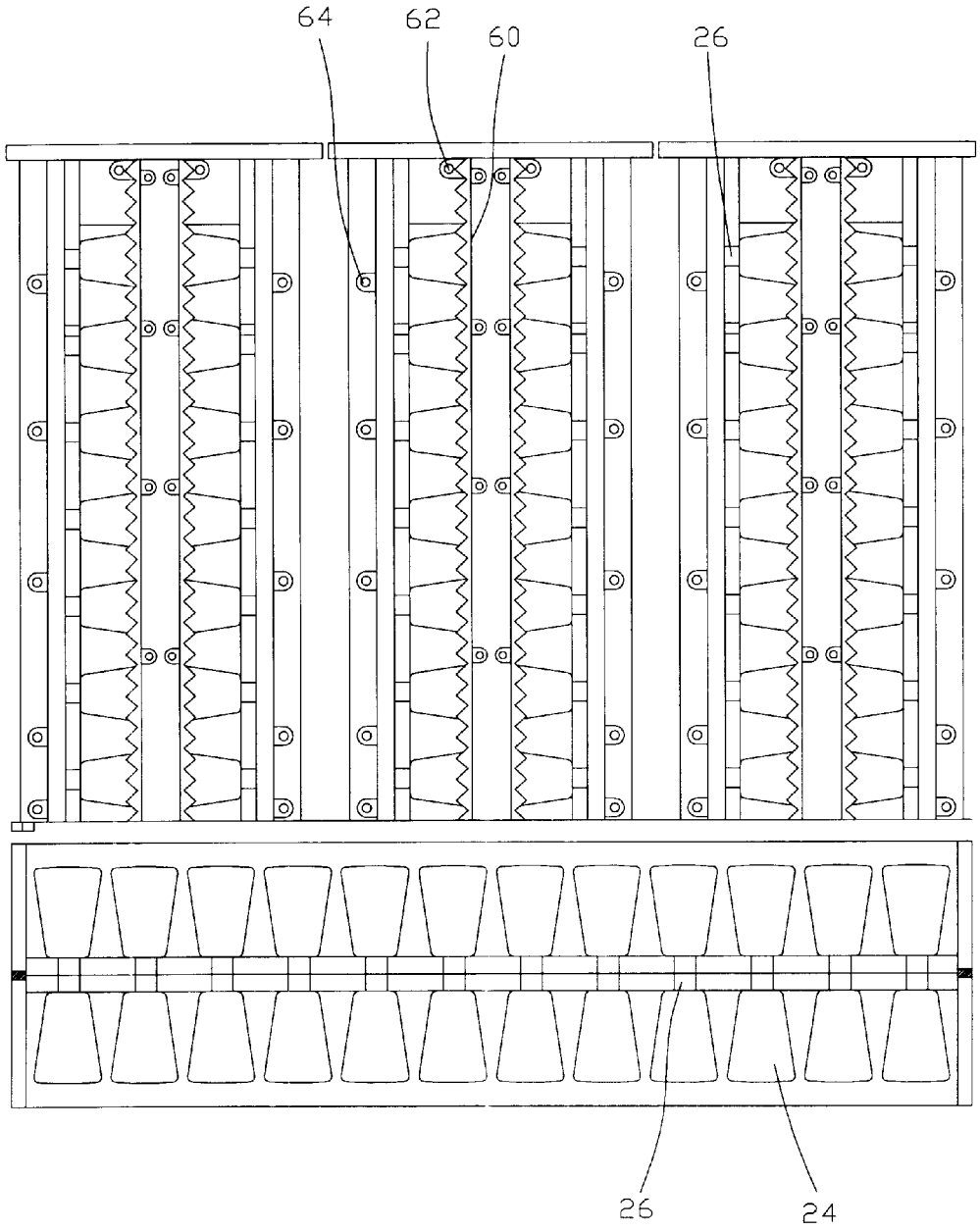
FIG. 5 is a schematic top view of the system in FIG. 1, reflecting slider cabinets in rear of the base cabinet according to another embodiment according to the present invention.
Figure 6:
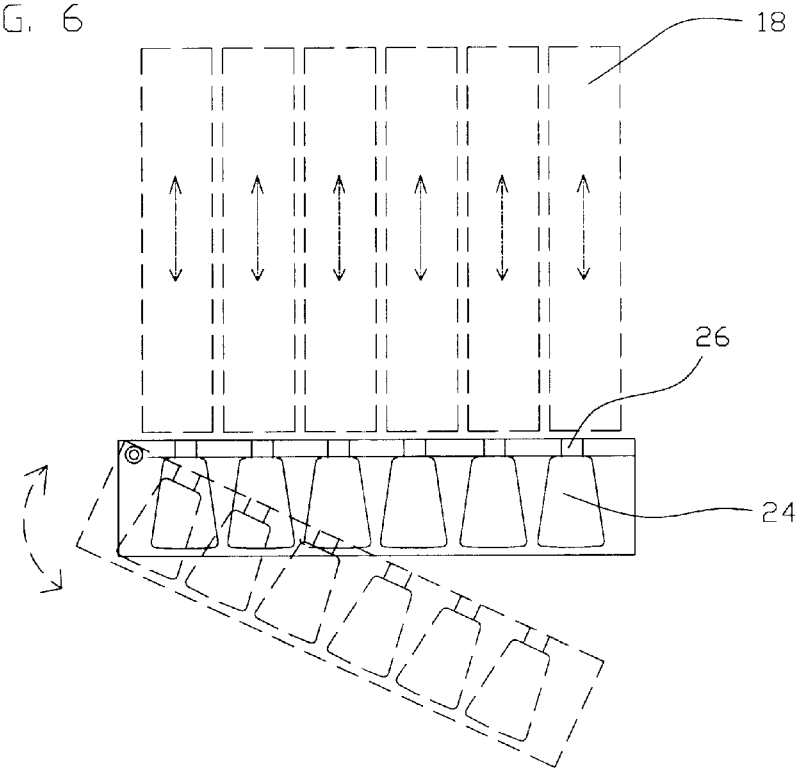
FIGS. 6–9 are operation views showing respective operations of cabinets according to the present invention.
Figure 7:
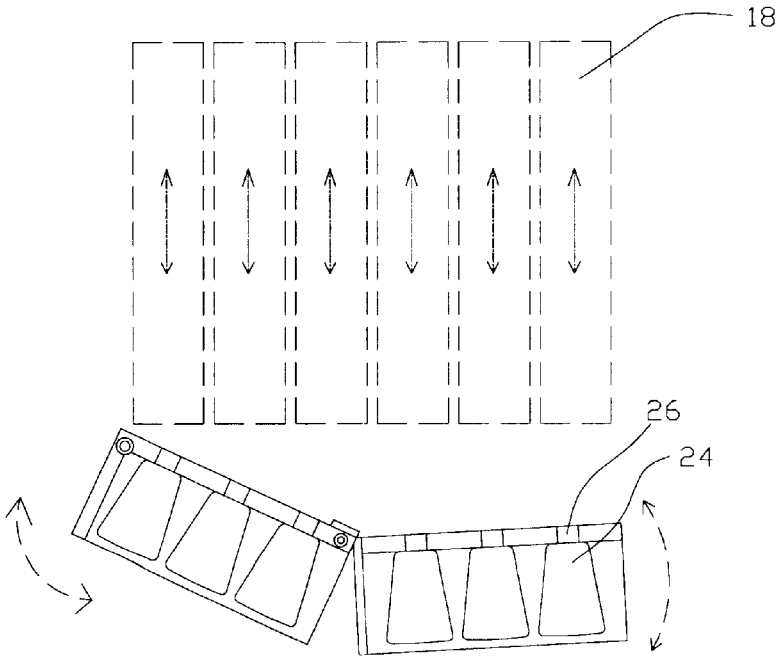

As further shown in FIGS. 4 and 5, one or more rack gears 60 and pinion gears 62 may be provided for the sliding operation of the slider cabinets 18. The rack gears 60 are linear and mounted in the framework 19. The rack gears 60 are preferably leveled even with the upper portion 20 of the tablet packaging unit 12. Each pinion gear 62 is attached to each slider cabinet 18 in correspondence to each rack gear 60. Also, the pinion gear 62 is leveled above each rack gear 60 to facilitate the back and forth sliding of each slider cabinet 18. Selectively, a plurality of rollers 64 may be formed along each linear rack gear 60.

Alternately, the linear rack gears 60 may be mounted on a lower portion 17 of each slider cabinet 18, wherein the rack gears 60 are leveled even with the upper portion 20 of the tablet packaging unit 12. So the pinion gear 62 becomes attached to the framework 19 in correspondence to each rack gear 60 and accordingly the pinion gear 62 is leveled below each rack gear 60 to facilitate the back and forth sliding of each slider cabinet 18.

In a preferred version, the first and second base cabinets 14, 16 may be formed unitary with each other so that a selected one of the side ends 14*c* can be swingably engaged to the tablet packaging unit 12. Here, it is recommended that the selected side end 14*c* of the base cabinet 14 is formed to swivel on the upper portion 20 of the tablet packaging unit 12. Selectively, the base cabinet 14 in the unitary formation may be foldably provided so that the rear surface 14*b* of the base cabinet 14 can be overlapped to itself when folded for cassette installation or cleaning of the tablet passages 26. To substantially increase tablet capacity, a plurality of base cabinets may be rotatably engaged to each other in a stacking formation by their selected side ends, wherein the engagement of the base cabinets may be implemented by hinges or swivels.

Figure 9:
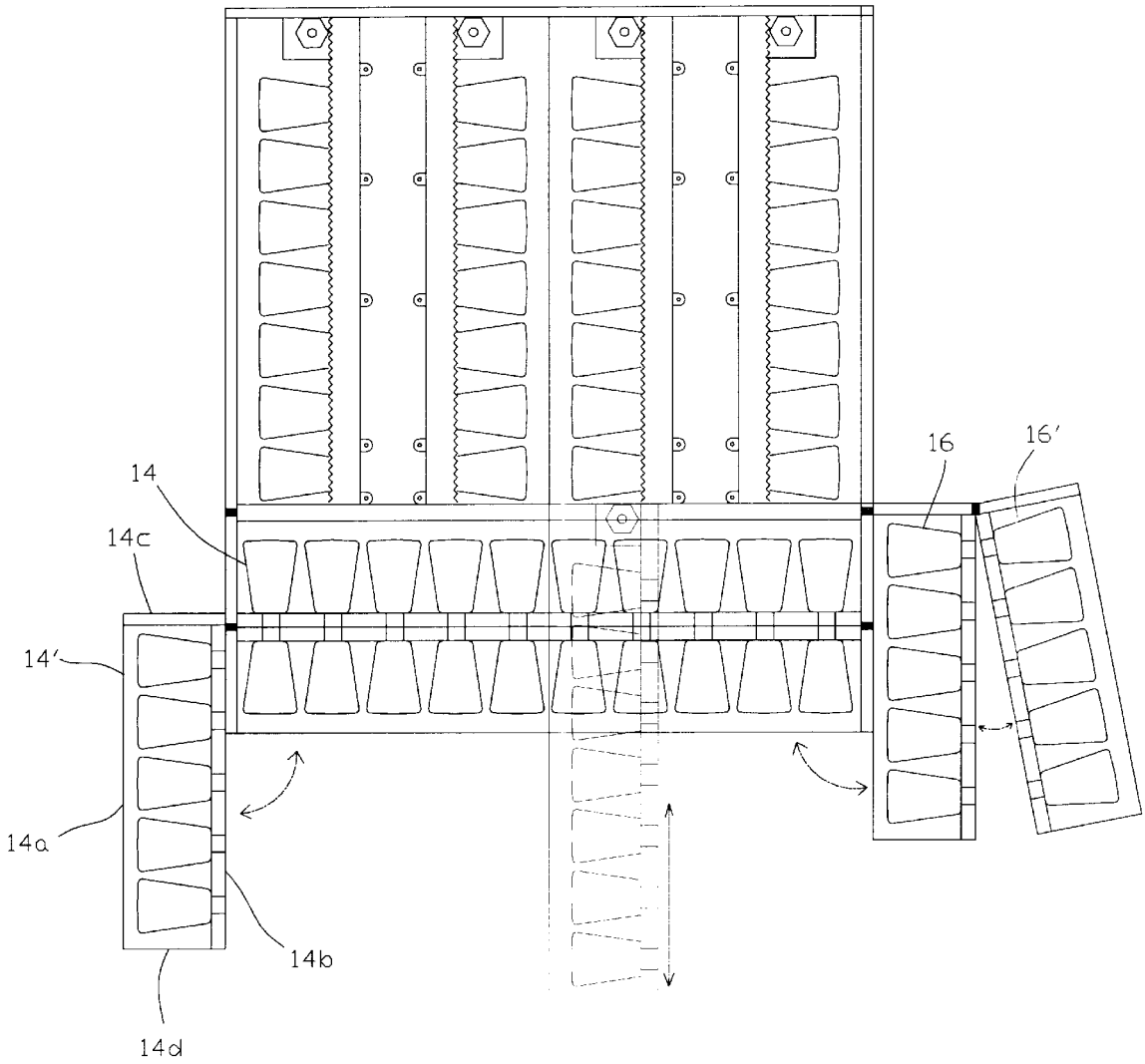

In another embodiment, as shown in FIG. 9, at least first to fourth base cabinets 14, 14', 16, 16' each defined by a front surface 14*a*, a rear surface 14*b*, and outer side end 14*c* and an inner side end 14*d*, wherein the first and second base cabinets 14, 16 are mounted on top of the upper portion 20 of the tablet packaging unit 12 and linearly aligned such that the inner side ends 14*d* of the first and second base cabinets 14, 16 approach each other. Also, one of the side ends of said each first and second base cabinet 14, 16 is swingably engaged to the tablet packaging unit 12, and one of the side ends of each third and fourth base cabinet 14', 16' is swingably engaged to said each first and second base cabinet 14, 16 using, for example, hinges or swivels.

As discussed above, the advantages of the automatic tablet dispensing and packaging system according to the present invention are numerous. First, the swingable mechanism of the tablet cassette cabinets enables a simultaneous vacuuming of each tablet passage in each cabinet by simply opening the base cabinets, wherein each tablet is dropped from each tablet cassette through the upright tablet passage into the tablet packaging unit.

Further, the sliding mechanism of the tablet cassettes in combination with the swing mechanism substantially increases tablet cassette capacity as well as improving tablet cassette management efficiency in a limited system installation space.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. An automatic tablet dispensing and packaging system, comprising:

a) a tablet packaging unit having an upper portion;

b) a first base cabinet mounted on top of the upper portion of the tablet packaging unit, wherein the base cabinet is defined by a front surface, a rear surface and side ends, wherein one of the side ends is swingably engaged to the tablet packaging unit;

c) one or more slider cabinets each defined by longer side surfaces and shorter end surfaces, wherein the slider cabinets are horizontally aligned behind the base cabinet such that each said longer side surface of the slider cabinets becomes perpendicular to the rear surface of the base cabinet when the base cabinets are swung closed, wherein the slider cabinets are linearly slidable to move back and forth so that the forward sliding, toward the base cabinet, of the slider cabinets can be effected when the base cabinet is swung open, whereby the slider cabinets are selectively pulled out through a space reserved by opening the base cabinet;

d) a plurality of tablet cassettes each containing therein and dropping therefrom a predetermined number of tablets, wherein the tablet cassettes are detachably racked in each said cabinet in columns and rows;

e) a guide hopper disposed beneath the cabinets into the tablet packaging unit so as to guide the tablets selectively dropped from the tablet cassettes into the tablet packaging unit; and f) a controller to administer the tablet dropping from the tablet cassettes and the tablet packaging in the tablet packaging unit.

2. The system of claim 1 wherein one of the side ends of base cabinet is swiveled on the upper portion of the tablet packaging unit.

3. The system of claim 1 wherein the base cabinet is foldable so that the rear surface of the base cabinet can be overlapped to itself when folded.

4. The system of claim 1 wherein the slider cabinets are partitioned in one or more pairs to enable a pair-by-pair sliding.

5. The system of claim 1 further comprising:

a) a framework adjacent to the tablet packaging unit;

b) one or more linear rack gears mounted in the framework, wherein the rack gears are leveled even with the upper portion of the tablet packaging unit; and c) a pinion gear attached to each said slider cabinet in correspondence to each said rack gear, wherein the pinion gear is leveled above each said rack gear to facilitate the back and forth sliding of each said slider cabinet.

6. The system of claim 5 wherein a plurality of rollers are formed along each said linear rack gear.

7. The system of claim 1 further comprising:

a) a framework adjacent to the tablet packaging unit;

b) one or more linear rack gears mounted on a lower portion of each said slider cabinet, wherein the rack gears are leveled even with the upper portion of the tablet packaging unit; and c) a pinion gear attached to the framework in correspondence to each said rack gear, wherein the pinion gear is leveled below each said rack gear to facilitate the back and forth sliding of each said slider cabinet.

8. The system of claim 7 wherein a plurality of rollers are formed along said each linear rack gear.

9. The system of claim 1 further comprising at least a second base cabinet having a side end, wherein the side end of the second base cabinet is swingably engaged to one of the side ends of the first base cabinet.

10. The system of claim 9 wherein the second base cabinet is foldable so that the rear surface of the second base cabinet can be overlapped to itself when folded.

11. The system of claim 1 wherein the tablet packaging unit comprises:

a) a printer to print respective information on a packaging paper; and b) a heater assembly to package the tablets released through the hopper into one or more partitioned paper bags using the packaging paper.

12. The system of claim 1 further comprising a plurality of upright tablet passages attached to each said cabinet to communicate with the tablet cassettes in each said cabinet, wherein the upright tablet passages are aligned with the tablet cassette columns to facilitate the tablet guidance from the tablet cassettes of the cabinets into the guide hopper.

13. An automatic tablet dispensing and packaging system, comprising:

a) a tablet packaging unit having an upper portion;

b) first and second base cabinets each defined by a front surface, a rear surface, an inner side end and an outer side end, wherein each said base cabinet is mounted on top of the upper portion of the tablet packaging unit and linearly aligned such that the inner side ends of the base cabinets face each other, wherein one of the side ends of each said base cabinet is swingably engaged to the tablet packaging unit;

c) one or more slider cabinets each defined by longer side surfaces and shorter end surfaces, wherein the slider cabinets are horizontally aligned behind the base cabinets such that each said longer side surface of the slider cabinets becomes perpendicular to the rear surface of each said base cabinet when the base cabinets are swung closed, wherein the slider cabinets are linearly slidable to move back and forth so that the forward sliding, toward the base cabinets, of the slider cabinets can be effected when the base cabinets are swung open, whereby the slider cabinets are selectively pulled out through a space reserved by opening the base cabinets;

d) a plurality of tablet cassettes each containing therein and dropping therefrom a predetermined number of tablets, wherein the tablet cassettes are detachably racked in each said cabinet in columns and rows;

e) a guide hopper disposed beneath the cabinets into the tablet packaging unit so as to guide the tablets selectively dropped from the tablet cassettes into the tablet packaging unit; and f) a controller to administer the tablet dropping from the tablet cassettes and the tablet packaging in the tablet packaging unit.

14. The system of claim 13 wherein the selected side end of each said base cabinet is swiveled on the upper portion of the tablet packaging unit.

15. The system of claim 13 wherein the slider cabinets are partitioned in one or more pairs to enable a pair-by-pair sliding.

16. The system of claim 13 further comprising:

a) a framework adjacent to the tablet packaging unit;

b) one or more linear rack gears mounted in the framework, wherein the rack gears are leveled even with the upper portion of the tablet packaging unit; and c) a pinion gear attached to each said slider cabinet in correspondence to each said rack gear, wherein the pinion gear is leveled above each said rack gear to facilitate the back and forth sliding of each said slider cabinet.

17. The system of claim 16 wherein a plurality of rollers are formed along each said linear rack gear.

18. The system of claim 13 further comprising:

a) a framework adjacent to the tablet packaging unit;

b) one or more linear rack gears mounted on a lower portion of each said slider cabinet, wherein the rack gears are leveled even with the upper portion of the tablet packaging unit; and c) a pinion gear attached to the framework in correspondence to each said rack gear, wherein the pinion gear is leveled below each said rack gear to facilitate the back and forth sliding of each said slider cabinet.

19. The system of claim 18 wherein a plurality of rollers are formed along each said linear rack gear.

20. The system of claim 18 wherein the tablet packaging unit comprises:

a) a printer to print respective information on a packaging paper; and b) a heater assembly to package the tablets released through the hopper into one or more partitioned paper bags using the packaging paper.

21. The system of claim 18 further comprising a plurality of upright tablet passages attached to each said cabinet to communicate with the tablet cassettes in each said cabinet, wherein the upright tablet passages are aligned with the tablet cassette columns to facilitate the tablet guidance from the tablet cassettes of the cabinets into the guide hopper.

22. An automatic tablet dispensing and packaging system, comprising:

a) a tablet packaging unit having an upper portion;

b) at least first to fourth base cabinets each defined by a front surface, a rear surface, and inner side end and an outer side end, wherein the first and second base cabinets are mounted on top of the upper portion of the tablet packaging unit and linearly aligned such that the inner side ends of the first and second base cabinets face each other, wherein one of the side ends of each said first and second base cabinet is swingably engaged to the tablet packaging unit, wherein one of the side ends of each said third and fourth base cabinet is swingably engaged to each said first and second base cabinet;

c) one or more slider cabinets each defined by longer side surfaces and shorter end surfaces, wherein the slider cabinet is horizontally aligned behind the first and second base cabinets such that each said longer side surface of the slider cabinets becomes perpendicular to the rear surface of each said first and second base cabinet when the base cabinets are swung closed, wherein the slider cabinets are linearly slidable to move back and forth so that the forward sliding, toward the base cabinets, of the slider cabinets can be effected when the base cabinets are swung open, whereby the slider cabinets are selectively pulled out through a space reserved by opening the base cabinets;

d) a plurality of tablet cassettes each containing therein and dropping therefrom a predetermined number of tablets, wherein the tablet cassettes are detachably racked in each said cabinet in columns and rows;

e) a guide hopper disposed beneath the cabinets into the tablet packaging unit so as to guide the tablets selectively dropped from the tablet cassettes into the tablet packaging unit; and f) a controller to administer the tablet dropping from the tablet cassettes and the tablet packaging in the tablet packaging unit.

23. The system of claim 22 wherein one of the side ends of each said first and second base cabinet is swiveled on the upper portion of the tablet packaging unit.

24. The system of claim 22 wherein the slider cabinets are partitioned in one or more pairs to enable a pair-by-pair sliding.

25. The system of claim 22 further comprising:

a) a framework adjacent to the tablet packaging unit;

b) one or more linear rack gears mounted in the framework, wherein the rack gears are leveled even with the upper portion of the tablet packaging unit; and c) a pinion gear attached to each said slider cabinet in correspondence to each said rack gear, wherein the pinion gear is leveled above each said rack gear to facilitate the back and forth sliding of each said slider cabinet.

26. The system of claim 25 wherein a plurality of rollers are formed along each said linear rack gear.

27. The system of claim 22 further comprising:

a) a framework adjacent to the tablet packaging unit;

b) one or more linear rack gears mounted on a lower portion of each said slider cabinet, wherein the rack gears are leveled even with the upper portion of the tablet packaging unit; and c) a pinion gear attached to the framework in correspondence to each said rack gear, wherein the pinion gear is leveled below each said rack gear to facilitate the back and forth sliding of each said slider cabinet.

28. The system of claim 27 wherein a plurality of rollers are formed along each said linear rack gear.

29. The system of claim 22 further comprising a plurality of upright tablet passages attached to each said cabinet to communicate with the tablet cassettes in each said cabinet, wherein the upright tablet passages are aligned with the tablet cassette columns to facilitate the tablet guidance from the tablet cassettes of the cabinets into the guide hopper.

30. The system of claim 22 wherein the tablet packaging unit comprises:

a) a printer to print respective information on a packaging paper; and b) a heater assembly to package the tablets released through the hopper into one or more partitioned paper bags using the packaging paper.

31. The system of claim 22 further comprising a plurality of upright tablet passages attached to each said cabinet to communicate with the tablet cassettes in each said cabinet, wherein the upright tablet passages are aligned with the tablet cassette columns to facilitate the tablet guidance from the tablet cassettes of the cabinets into the guide hopper.

* * * * *